US011715449B2

(12) United States Patent
Flory

(10) Patent No.: US 11,715,449 B2
(45) Date of Patent: Aug. 1, 2023

(54) KEYBOARD WITH STRUM STRING APPARATUS

(71) Applicant: Adam Flory, Clarksburg, PA (US)

(72) Inventor: Adam Flory, Clarksburg, PA (US)

( * ) Notice: Subject to any disclaimer, the term of this patent is extended or adjusted under 35 U.S.C. 154(b) by 426 days.

(21) Appl. No.: 16/997,632

(22) Filed: Aug. 19, 2020

(65) Prior Publication Data

US 2022/0059065 A1 Feb. 24, 2022

(51) Int. Cl.
*G10H 3/18* (2006.01)
*G10H 1/34* (2006.01)

(52) U.S. Cl.
CPC ..... *G10H 3/185* (2013.01); *G10H 1/342* (2013.01); *G10H 2220/471* (2013.01); *G10H 2220/501* (2013.01)

(58) Field of Classification Search
CPC .. G10H 3/185; G10H 1/342; G10H 2220/471; G10H 2220/501; G10H 2220/191; G10H 2220/165
See application file for complete search history.

(56) References Cited

U.S. PATENT DOCUMENTS 4,336,734 A * 6/1982 Polson ..... G10H 1/342 84/646
4,658,690 A * 4/1987 Aitken ..... G10H 1/342 84/646
4,794,838 A * 1/1989 Corrigau, III ..... G10H 1/342 984/340
4,911,053 A * 3/1990 Kashio ..... G10H 1/0555 84/DIG. 24
5,085,119 A * 2/1992 Cole ..... G10H 1/342 84/730
5,726,374 A 3/1998 Vandervoort
5,739,455 A * 4/1998 Poon ..... G10H 1/0083 84/478
7,408,108 B2 8/2008 Ludwig
8,669,458 B2 * 3/2014 Piccionelli ..... G10H 3/22 84/622
9,082,384 B1 * 7/2015 Cohen ..... G10H 1/344
9,153,222 B1 10/2015 Wong
9,263,004 B1 * 2/2016 Brown ..... G10H 3/18
9,573,049 B2 2/2017 Rubin
9,747,878 B1 8/2017 Atakhanian
10,360,887 B2 * 7/2019 Schlessinger ..... G10H 1/0066
2010/0307314 A1 * 12/2010 Piccionelli ..... G10H 1/342 84/285
2014/0283670 A1 * 9/2014 Eventoff ..... G10H 1/34 84/723
2017/0032775 A1 * 2/2017 Schlessinger ..... G10H 1/0556
2017/0278500 A1 * 9/2017 Hanks ..... G10H 1/342

* cited by examiner

*Primary Examiner* — Jeffrey Donels

(57) ABSTRACT

A keyboard with strum string apparatus for creating accurate guitar sounds with an electronic keyboard includes a microcontroller is coupled within a keyboard body. A power source, a pair of speakers, a plurality of control buttons, and a plurality of piano keys are coupled to the keyboard body and are in operational communication with the microcontroller. A plurality of piano keys is coupled to the keyboard body. A strum board is coupled to the keyboard body. The strum board has a strum base coupled to the keyboard body, a pair of bridges coupled to the strum base, a plurality of strings extending between the pair of bridges, and a pickup coupled to the strum base. The pickup is in operational communication with the microcontroller.

8 Claims, 4 Drawing Sheets

KEYBOARD WITH STRUM STRING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

The Names of the Parties to a Joint Research Agreement

Not Applicable

Incorporation-by-Reference of Material Submitted on a Compact Disc or as a Text File Via the Office Electronic Filing System Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to keyboard devices and more particularly pertains to a new keyboard device for creating accurate guitar sounds with an electronic keyboard.

(2) Description of Related Art Including Information Disclosed Under 37 CFR 1.97 and 1.98

The prior art relates to keyboard devices. Known devices recreate guitar and other string instrument sounds through a variety of methods. Such devices, however, require the user to play the notes with the keys of the keyboard and thus do not accurately replicate the strumming sounds of the original instrument. Existing devices do not include an input with strings.

BRIEF SUMMARY OF THE INVENTION

An embodiment of the disclosure meets the needs presented above by generally comprising a keyboard body having a body top side, a body bottom side, a body front side, a body back side, a body left side, and a body right side. A microcontroller is coupled within the keyboard body. A power source is coupled within the keyboard body and is in operational communication with the microcontroller. A pair of speakers is coupled to the body top side and is in operational communication with the microcontroller. A plurality of control buttons is coupled to the keyboard body. The plurality of control buttons is in operational communication with the microcontroller. A plurality of piano keys is coupled to the keyboard body. The plurality of piano keys is in operational communication with the microcontroller. A strum board is coupled to the keyboard body. The strum board has a strum base coupled to the keyboard body, a pair of bridges coupled to the strum base, a plurality of strings extending between the pair of bridges, and a pickup coupled to the strum base. The pickup is in operational communication with the microcontroller.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
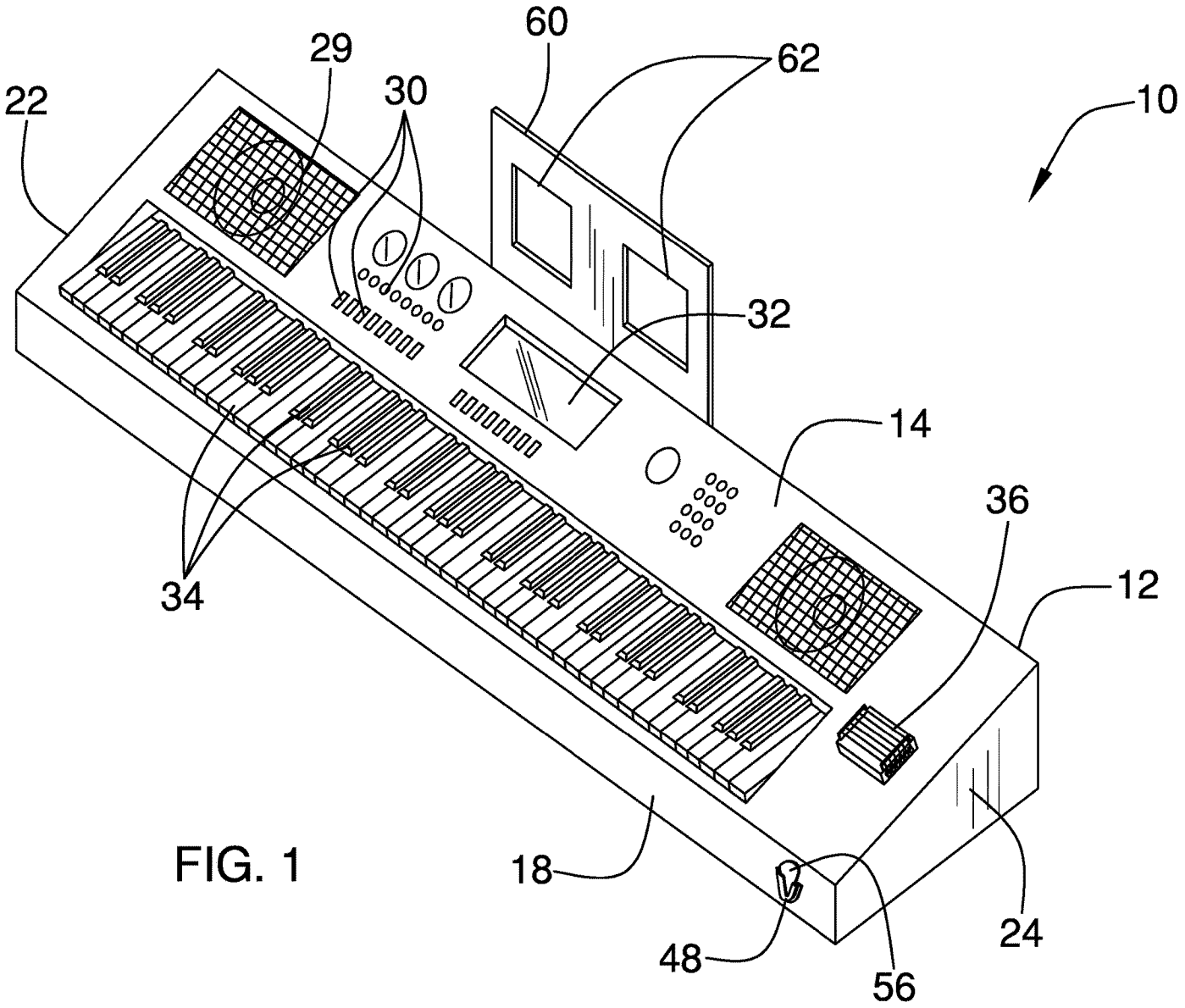
FIG. 1 is an isometric view of a keyboard with strum string apparatus according to an embodiment of the disclosure.
Figure 2:
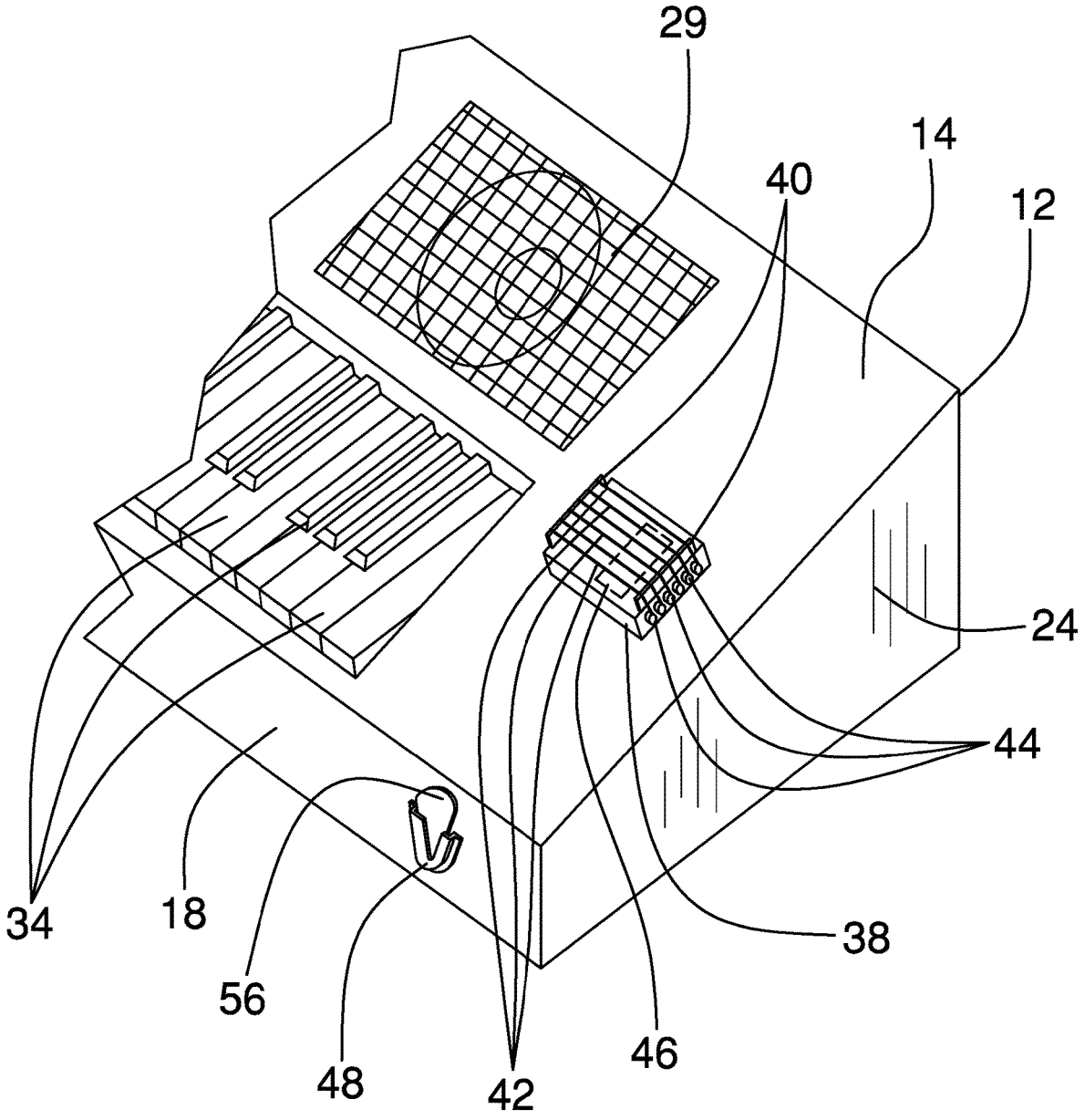
FIG. 2 is a detail view of an embodiment of the disclosure.
Figure 3:
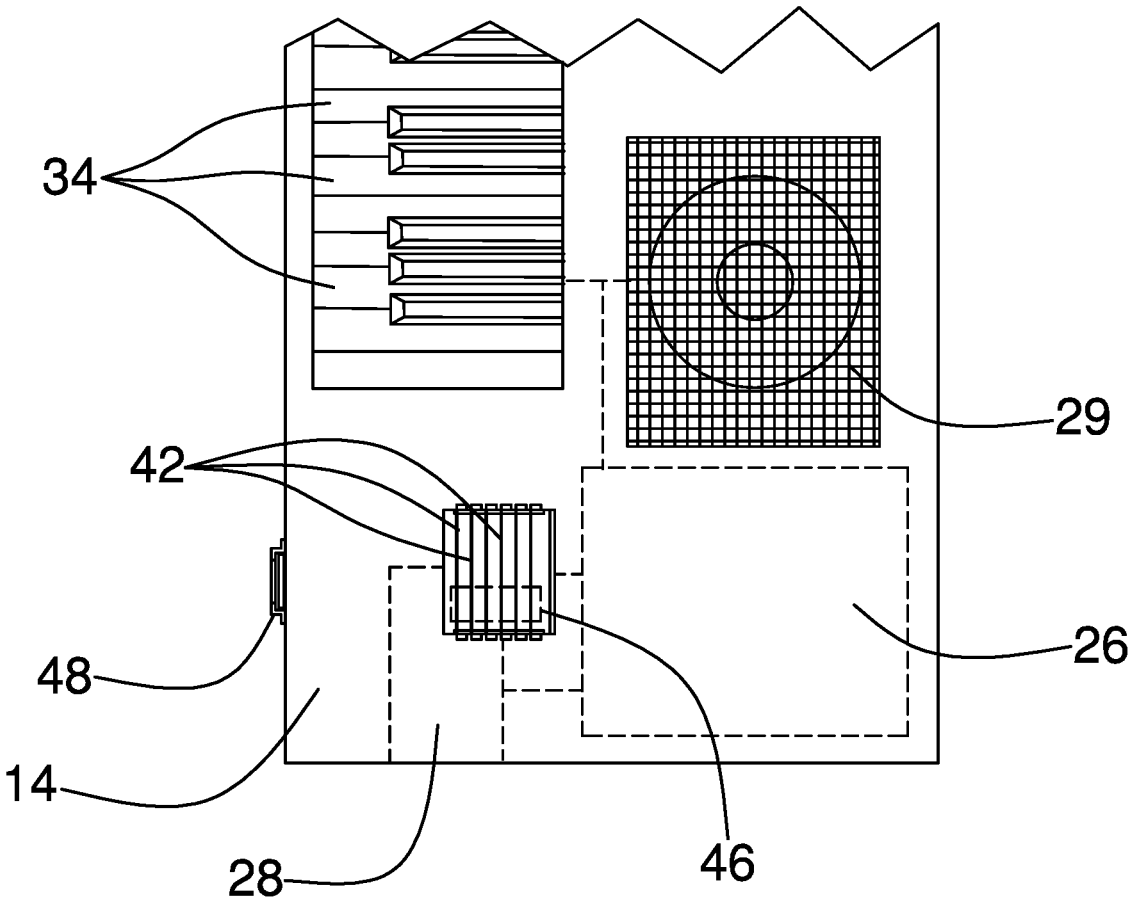
FIG. 3 is a top plan view of an embodiment of the disclosure.
Figure 4:
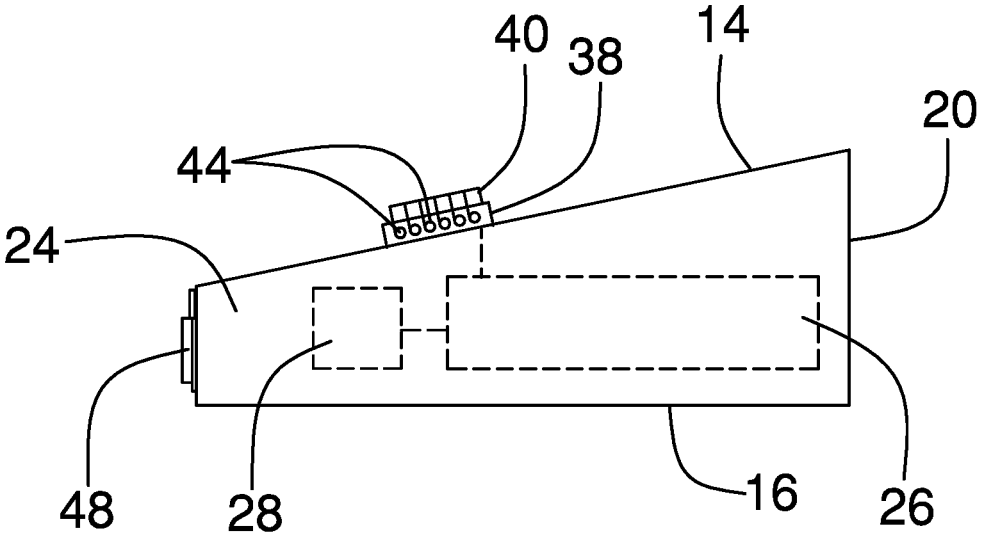
FIG. 4 is a side elevation view of an embodiment of the disclosure.
Figure 5:
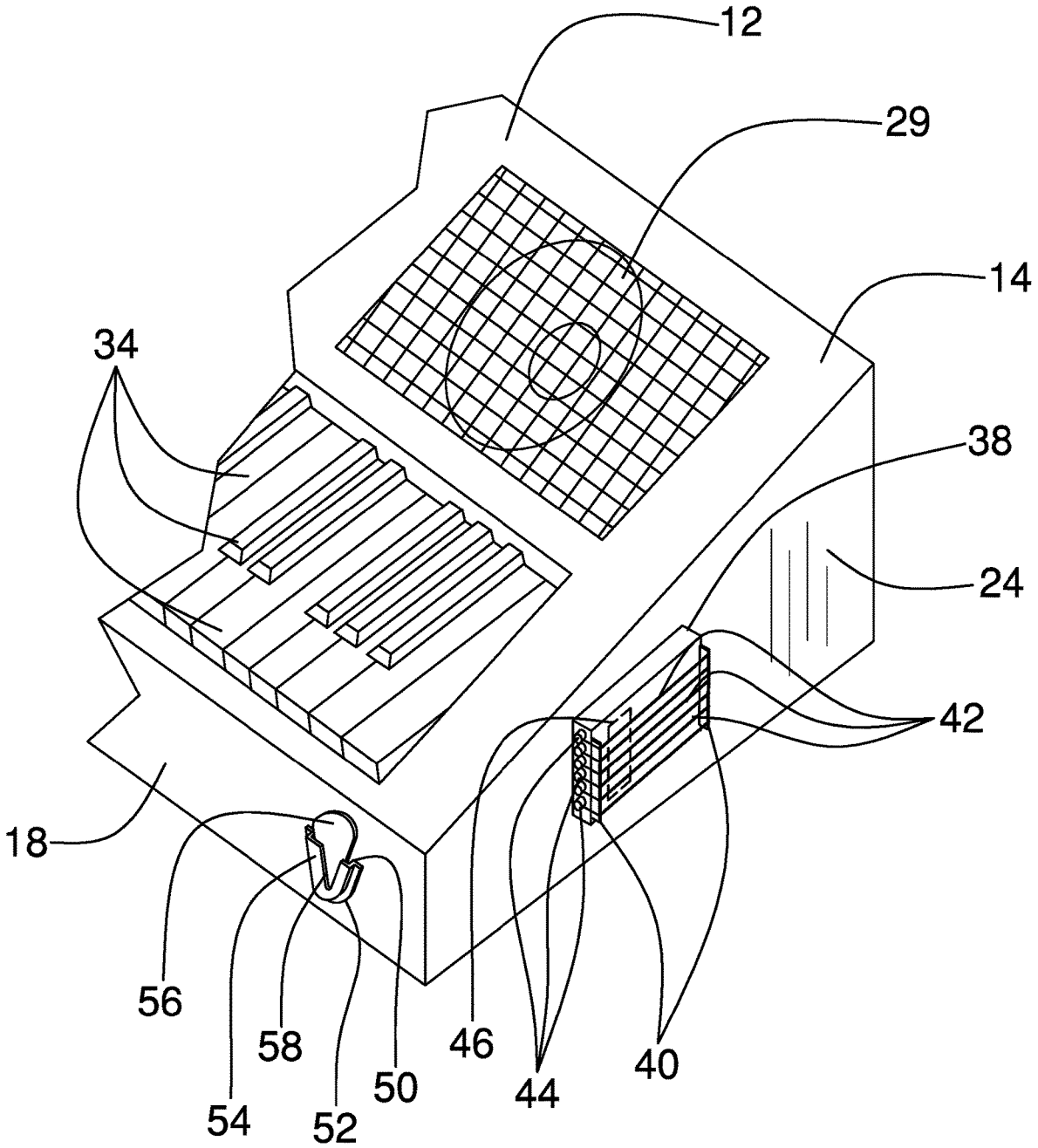
FIG. 5 is a detail view of an embodiment of the disclosure.

With reference now to the drawings, and in particular to FIGS. 1 through 5 thereof, a new keyboard device embodying the principles and concepts of an embodiment of the disclosure and generally designated by the reference numeral 10 will be described.

As best illustrated in FIGS. 1 through 5, the keyboard with strum string apparatus 10 generally comprises a keyboard body 12 having a body top side 14, a body bottom side 16, a body front side 18, a body back side 20, a body left side 22, and a body right side 24. The body back side 20 may be taller than the body front side 18 to pitch the body top side 14.

A microcontroller 26 is coupled within the keyboard body 12. A power source 28 is coupled within the keyboard body 12 and is in operational communication with the microcontroller 26. A pair of speakers 29 is coupled to the keyboard body 12. The pair of speakers 28 is coupled to the body top side 14 and is in operational communication with the microcontroller 26 to play generated sounds.

A plurality of control buttons 30 is coupled to the keyboard body 12. The plurality of control buttons 30 is in operational communication with the microcontroller 26 to manipulate the sounds being generated and to play prerecorded music. A display 32 may be coupled to the keyboard body 12. The display 32 is coupled to the body top side 14 and is in operational communication with the microcontroller 26 to help the user navigate the functions of the plurality of control buttons 30. A plurality of piano keys 34 is coupled to the keyboard body 12 and is in operational communication with the microcontroller 26.

A strum board 36 is coupled to the keyboard body 12. The strum board 36 has a strum base 38 coupled to the keyboard body 12, a pair of bridges 40 coupled to the strum base 38, a plurality of strings 42 extending between the pair of bridges 40 and coupled to a plurality of pegs 44 of the strum base, and a pickup 46 coupled to the strum base 38. The strum base 38 may be coupled to the body top side 14 proximal the body right side 24 or may alternatively be coupled to the body right side 24. The pickup 46 is in operational communication with the microcontroller 26.

A pick holder 48 is coupled to the keyboard body 12. The pick holder 48 may be U-shaped and has an open holder top side 50. The pick holder 48 has a flange portion 52 coupled to the body front side 18 proximal the strum board 36 and a lip portion 54 extending from the flange portion 52. The pick holder 48 is configured to secure a guitar pick 56 for the user to play the strum board 36. The lip portion 54 may be a V-shaped cutout 58 to allow for easier access to the guitar pick 56.

There may be a music holder 60 coupled to the keyboard body 12. The music holder 60 may extend from the body back side 20 above the body top side 14. The music holder 60 may have a pair of square apertures 62 extending therethrough.

In use, the user manipulates the plurality of control buttons 30 and the plurality of piano keys 34 as with a traditional electronic keyboard. The user may additionally play the strum board 36 by strumming or plucking the plurality of strings 42 to recreate accurate sounds from string instruments such as a guitar. While playing the strum board 36 the plurality of piano keys 34 may be used to manipulate which notes and chords are being played.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A keyboard with strum string apparatus comprising:

a keyboard body having a body top side, a body bottom side, a body front side, a body back side, a body left side, and a body right side;

a microcontroller coupled within the keyboard body;

a power source coupled within the keyboard body, the powers source being in operational communication with the microcontroller;

a pair of speakers coupled to the keyboard body, the pair of speakers being coupled to the body top side and being in operational communication with the microcontroller;

a plurality of control buttons coupled to the keyboard body, the plurality of control buttons being in operational communication with the microcontroller;

a plurality of piano keys coupled to the keyboard body, the plurality of piano keys being in operational communication with the microcontroller; and a strum board coupled to the keyboard body, the strum board having a strum base coupled to the keyboard body, a pair of bridges coupled to the strum base, a plurality of strings extending between the pair of bridges, and a pickup coupled to the strum base, the pickup being in operational communication with the microcontroller, the strum base having a plurality of pegs, the plurality of strings being coupled to the plurality of pegs; and a pick holder coupled to the keyboard body, the pick holder being configured to secure a guitar pick.

2. The keyboard with strum string apparatus of claim 1 further comprising the strum base being coupled to the body top side proximal the body right side.

3. The keyboard with strum string apparatus of claim 1 further comprising the strum base being coupled to the body right side.

4. The keyboard with strum string apparatus of claim 1 further comprising the pick holder being coupled to the body front side proximal the body right side.

5. The keyboard with strum string apparatus of claim 1 further comprising the pick holder being U-shaped and having an open holder top side.

6. The keyboard with strum string apparatus of claim 5 further comprising the pick holder having a flange portion coupled to the body front side and a lip portion extending from the flange portion, the lip portion having a V-shaped cutout.

7. The keyboard with strum string apparatus of claim 1 further comprising a display coupled to the keyboard body, the display being coupled to the body top side and being in operational communication with the microcontroller.

8. A keyboard with strum string apparatus comprising:

a keyboard body having a body top side, a body bottom side, a body front side, a body back side, a body left side, and a body right side;

a microcontroller coupled within the keyboard body;

a power source coupled within the keyboard body, the powers source being in operational communication with the microcontroller;

a pair of speakers coupled to the keyboard body, the pair of speakers being coupled to the body top side and being in operational communication with the microcontroller;

a plurality of control buttons coupled to the keyboard body, the plurality of control buttons being in operational communication with the microcontroller;

a display coupled to the keyboard body, the display being coupled to the body top side and being in operational communication with the microcontroller;

a plurality of piano keys coupled to the keyboard body, the plurality of piano keys being in operational communication with the microcontroller;

a strum board coupled to the keyboard body, the strum board having a strum base coupled to the keyboard body, the strum base being coupled to the body top side proximal the body right side, a pair of bridges coupled to the strum base, a plurality of strings extending between the pair of bridges and coupled to a plurality of pegs of the strum base, and a pickup coupled to the strum base, the pickup being in operational communication with the microcontroller; and a pick holder coupled to the keyboard body, the pick holder being U-shaped and having an open holder top side, the pick holder having a flange portion coupled to the body front side and a lip portion extending from the flange portion, the lip portion having a V-shaped cutout, the pick holder being configured to secure a guitar pick.

* * * * *